US007176856B2

(12) United States Patent
Yahagi et al.

(10) Patent No.: US 7,176,856 B2
(45) Date of Patent: Feb. 13, 2007

(54) DISPLAY DEVICE AND DISPLAY PANEL DRIVE METHOD

(75) Inventors: Kazuo Yahagi, Yamanashi-ken (JP); Tsutomu Tokunaga, Yamanashi-ken (JP); Yuya Shiozaki, Yamanashi-ken (JP); Shigeru Iwaoka, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 587 days.

(21) Appl. No.: 10/743,867

(22) Filed: Dec. 24, 2003

(65) Prior Publication Data

US 2004/0179004 A1 Sep. 16, 2004

(30) Foreign Application Priority Data

Dec. 26, 2002 (JP) ..... 2002-377685

(51) Int. Cl.
*G09G 3/28* (2006.01)

(52) U.S. Cl. ..... 345/68; 345/63; 345/60; 315/169.4

(58) Field of Classification Search ..... 345/60–68, 345/211, 204, 209; 315/169.4; 313/31, 313/231

See application file for complete search history.

(56) References Cited

U.S. PATENT DOCUMENTS 6,281,863 B1 8/2001 Sasaki et al.
6,313,580 B1 11/2001 Makino et al.
6,528,952 B2 * 3/2003 Kato et al. ..... 315/169.4
6,674,238 B2 * 1/2004 Otani et al. ..... 313/587

FOREIGN PATENT DOCUMENTS

EP 1 276 131 A2 1/2003
EP 1 294 006 A2 3/2003
JP 5-205642 A 8/1993

* cited by examiner

*Primary Examiner*—Richard Hjerpe
*Assistant Examiner*—Duc Dinh
(74) *Attorney, Agent, or Firm*—Sughrue Mion, PLLC

(57) ABSTRACT

The present invention is a display device and display panel drive method that allow a more rapid select operation to be stably implemented by increasing the discharge probability of selective discharge. The display device comprises an address part that sequentially applies a positive scan pulse to a first row electrode of each of the display panel row electrode pairs in the address cycle while sequentially applying a pixel data pulse corresponding to the pixel data at the same timing as the scan pulse to each of the display panel column electrodes one display line at a time so that the column electrode side constitutes a cathode, such that an address discharge is selectively produced in the second discharge cell; and a sustain part that applies a sustain pulse to each of the row electrodes constituting the row electrode pairs in the sustain cycle, and the sustain part applies the ultimate sustain pulse of the sustain pulses applied in the address cycle to the first row electrode with a negative polarity.

11 Claims, 18 Drawing Sheets

II - II CROSS - SECTION

III - III CROSS - SECTION

VII – VII

VIII - VIII

FIG. 10

| GRAY SCALE DRIVE | CONVERSION TABLE | | | | | | | | | | | | | | | | LIGHT EMISSION PATTERN | | | | | | | | | | | | | | |
|---|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | 15 | SF 1 | SF 2 | SF 3 | SF 4 | SF 5 | SF 6 | SF 7 | SF 8 | SF 9 | SF 10 | SF 11 | SF 12 | SF 13 | SF 14 | SF 15 |
| FIRST | 0000 | 1 | 0 | 0 | 0 | 0 | 0 | 0 | 0 | 0 | 0 | 0 | 0 | 0 | 0 | 0 | ● | | | | | | | | | | | | | | |
| SECOND | 0001 | 0 | 1 | 0 | 0 | 0 | 0 | 0 | 0 | 0 | 0 | 0 | 0 | 0 | 0 | 0 | ○ | ● | | | | | | | | | | | | | |
| THIRD | 0010 | 0 | 0 | 1 | 0 | 0 | 0 | 0 | 0 | 0 | 0 | 0 | 0 | 0 | 0 | 0 | ○ | ○ | ● | | | | | | | | | | | | |
| FOURTH | 0011 | 0 | 0 | 0 | 1 | 0 | 0 | 0 | 0 | 0 | 0 | 0 | 0 | 0 | 0 | 0 | ○ | ○ | ○ | ● | | | | | | | | | | | |
| FIFTH | 0100 | 0 | 0 | 0 | 0 | 1 | 0 | 0 | 0 | 0 | 0 | 0 | 0 | 0 | 0 | 0 | ○ | ○ | ○ | ○ | ● | | | | | | | | | | |
| SIXTH | 0101 | 0 | 0 | 0 | 0 | 0 | 1 | 0 | 0 | 0 | 0 | 0 | 0 | 0 | 0 | 0 | ○ | ○ | ○ | ○ | ○ | ● | | | | | | | | | |
| SEVENTH | 0110 | 0 | 0 | 0 | 0 | 0 | 0 | 1 | 0 | 0 | 0 | 0 | 0 | 0 | 0 | 0 | ○ | ○ | ○ | ○ | ○ | ○ | ● | | | | | | | | |
| EIGHTH | 0111 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | |
| NINTH | 1000 | 0 | 0 | 0 | 0 | 0 | 0 | 0 | 0 | 1 | 0 | 0 | 0 | 0 | 0 | 0 | ○ | ○ | ○ | ○ | ○ | ○ | ○ | ○ | ● | | | | | | |
| TENTH | 1001 | 0 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ○ | ● | | | | | |
| ELEVENTH | 1010 | 0 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ○ | ● | | | | |
| TWELFTH | 1011 | 0 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ○ | ● | | | |
| THIRTEENTH | 1100 | 0 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ○ | ● | | |
| FOURTEENTH | 1101 | 0 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ○ | ● | |
| FIFTEENTH | 1110 | 0 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ○ | ● |
| SIXTEENTH | 1111 | 0 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ |

● : ERASURE ADDRESS DISCHARGE ○ : SUSTAIN DISCHARGE LIGHT EMISSION

XV - XV

XVI - XVI

XVII - XVII

DISPLAY DEVICE AND DISPLAY PANEL DRIVE METHOD

BACKGROUND OF THE INVENTION

1. Field of the Invention

The present invention relates to a display device with a built-in panel and a display panel drive method.

2. Description of Related Art

In recent years, plasma display devices with built-in surface discharge method AC-type plasma display panels that constitute large, thin color display panels have attracted attention (see Japanese Patent Kokai No. H5-205642, for example).

FIGS. 1 to 3 show part of the structure of such a conventional surface discharge method AC-type plasma display panel.

Plasma display panels (PDP) are formed having a structure that serves to generate a discharge for each pixel between a front face glass substrate 1 and a rear face glass substrate 4 that are disposed in parallel with each other, as shown in FIG. 2. The surface of the front face glass substrate 1 is the display face. The rear face side of the front face glass substrate 1 is sequentially provided with a plurality of longitudinal row electrode pairs (X', Y'), a dielectric layer 2 for covering the row electrode pairs (X', Y'), and a protective layer 3 consisting of MgO (magnesium oxide) for covering the rear face of the dielectric layer 2. As shown in FIG. 1, each of the row electrodes X', Y' is constituted by a transparent electrode Xa' and Ya', respectively, that consists of a wide ITO or other transparent electrically conductive film, and by bus electrodes Xb' and Yb', respectively, that consists of a narrow metal film that supplements the electrical conductivity. The row electrodes X' and Y' are arranged alternately in the vertical direction of the display screen so as to face each other with a discharge gap g' interposed therebetween, where a single display line (row) L of a matrix display is constituted by each pair of row electrodes (X', Y'). As shown in FIG. 3, the rear face glass substrate 4 is provided with a plurality of column electrodes D' that are arranged in a direction orthogonal to the row electrode pairs X', Y', belt-shaped barrier walls 5 that are formed in parallel between these column electrodes D', and a phosphor layer 6, which is formed by Red (R), Green (G), and Blue (B) phosphor materials that cover the sides of the barrier walls 5 and the column electrodes D', is provided. As shown in FIG. 2, discharge spaces S' in which Ne—Xe gas containing xenon is enclosed exists between the protective layer 3 and phosphor layer 6. Each display line L is formed having a discharge cell C' constituting a unit light emission region in which the discharge spaces S' are divided by the barrier walls 5 at the points of intersection between the column electrodes D' and the row electrode pairs (X', Y'), as shown in FIG. 1.

As a method for displaying halftones in the image formation of the above-mentioned surface discharge method AC-type PDP, a grayscale drive method that uses subfields is known. In this drive method, a single field display cycle is divided into N subfields, and a number of light emissions that matches the weighting of the subfield is allocated to each subfield. Further, light emission drive is performed by setting subfields in which light emission is implemented for each discharge cell and subfields in which light emission does not take place in accordance with an input picture signal. Here, a middle luminance corresponding with the total number of light emissions implemented via a single field is visualized.

FIG. 4 shows a variety of drive pulses that are applied to the PDP in each subfield in order to implement the drive.

As shown in FIG. 4, each subfield is constituted by a batch reset cycle Rc, an address cycle Wc, and a sustain cycle Ic.

In the batch reset cycle Rc, a reset discharge is performed simultaneously for all the discharge cells as a result of reset pulses $RP_x$, $RP_y$ being applied simultaneously between row electrodes $X_1'$ to $X_n'$ and $Y_1'$ to $Y_n'$, respectively, that together form pairs, and, as a result, a wall charge of a predetermined amount is temporarily formed in each discharge cell. In the address cycle Wc that follows, a scan pulse SP is sequentially applied to the row electrodes $Y_1'$ to $Y_n'$, and a pixel data pulse for each pixel corresponding with an input picture signal is applied to the column electrodes $D_1'$ to $D_m'$ one display line at a time. That is, as shown in FIG. 4, image data pulse groups $DP_1$ to $DP_n$ consisting of m pixel data pulses each corresponding with first to nth display lines are sequentially applied to the column electrodes $D_1'$ to $D_m'$ in sync with the scan pulse SP. An address discharge (selective erasure discharge) takes place only in the discharge cells to which a high voltage pixel data pulse is applied at the same time as the scan pulse. The wall charge formed in the discharge cells by this address discharge then disappears. On the other hand, the wall charge remains in the discharge cells in which the address discharge has not occurred. In the sustain cycle Ic that follows, sustain pulses $IP_x$, $IP_y$ is applied between the row electrodes $X_1'$ to $X_n'$ and $Y_1'$ to $Y_n'$ that together form pairs in a number corresponding with the weighting of each subfield. Accordingly, the sustain discharge is repeated only in a number corresponding with the number of applied sustain pulses $IP_x$, $IP_y$, only in the light emission cells in which the wall charge still remains. As a result of this sustain discharge, vacuum ultraviolet rays with a wavelength of 147 nm are emitted by the xenon Xe enclosed in the discharge spaces S'. As a result of these vacuum ultraviolet rays, the Red (R), Green (G), and Blue (B) phosphor layer formed on the rear face substrate is excited to generate visible light.

In a display panel like a conventional surface discharge method AC-type PDP, the MgO layer formed on the dielectric layer of the surface substrate comprises a protective function with respect to ion bombardment and a secondary electron discharge function for performing a stable operation by raising the discharge probability. The MgO layer is superior with respect to the a characteristic for discharging secondary electrons during discharge in which the formation face is the cathode, and the discharge probability can be raised. However, because the MgO layer also has an ultraviolet ray absorption characteristic, same cannot be formed on the rear face substrate side (phosphor formation face side). Therefore, in the selective discharge (address discharge) between the column electrodes and scan electrodes of a conventional display panel, the column electrode side on the rear face substrate side is the anode and the scan electrodes on the front face substrate side constitute the cathode, that is, selective discharge is produced by applying a positive data pulse to the column electrodes and a negative scan pulse to the scan electrodes.

The above problems are cited as an example of the problems that the present invention is intended to resolve, an object of the present invention being to provide a display device and display panel drive method that permit an increase in the selective operation to be stably implemented by increasing the discharge probability of the selective discharge.

SUMMARY OF THE INVENTION

The display device of the present invention is a display device that displays an image by dividing a single field display cycle into cycles of a plurality of subfields each having an address cycle and a sustain cycle, in accordance with pixel data for each pixel on the basis of an input picture signal, comprising: a display panel having a front face substrate and a rear face substrate disposed facing each other with a discharge space interposed therebetween, a plurality of row electrode pairs provided on the inner face of the front face substrate, and a plurality of column electrodes arranged so as to intersect the row electrode pairs on the inner face of the rear substrate, a unit light emission region, which consists of a first discharge cell, and a second discharge cell in which a light absorption layer is provided on the front face substrate side and a secondary electron discharge material layer is provided on the rear face substrate side, being formed at each intersection between the row electrode pairs and the column electrodes; an address part that sequentially applies a positive scan pulse to a first row electrode of each of the row electrode pairs in the address cycle while sequentially applying a pixel data pulse corresponding to the pixel data at the same timing as the scan pulse to each of the column electrodes one display line at a time so that the column electrode side constitutes a cathode, such that an address discharge is selectively produced in the second discharge cell; and a sustain part that applies a sustain pulse to each of the row electrodes constituting the row electrode pairs in the sustain cycle, wherein the sustain part applies the ultimate sustain pulse of the sustain pulses applied in the sustain cycle to the first row electrode with a negative polarity.

The drive method of the display panel of the present invention is a drive method that drives a display panel in accordance with pixel data for each pixel on the basis of an input image signal, the display panel having a front face substrate and a rear face substrate disposed facing each other with a discharge space interposed therebetween, a plurality of row electrode pairs provided on the inner face of the front face substrate, and a plurality of column electrodes arranged so as to intersect the row electrode pairs on the inner face of the rear substrate, a unit light emission region, which consists of a first discharge cell, and a second discharge cell in which a light absorption layer is provided on the front face substrate side and a secondary electron discharge material layer is provided on the rear face substrate side, being formed at each intersection between the row electrode pairs and the column electrodes, wherein: a single field display cycle is constituted by cycles of a plurality of subfields each having an address cycle and a sustain cycle; a positive scan pulse is sequentially applied to a first row electrode of each of the row electrode pairs in the address cycle while a pixel data pulse corresponding to the pixel data is sequentially applied at the same timing as the scan pulse to each of the column electrodes one display line at a time so that the column electrode side constitutes a cathode, such that an address discharge is selectively produced in the second discharge cell; a sustain pulse is applied to each of the row electrodes constituting the row electrode pairs in the sustain cycle; and the ultimate sustain pulse of the sustain pulses applied in the sustain cycle is applied to the first row electrode with a negative polarity.

BRIEF DESCRIPTION OF THE DRAWINGS

FIG. 10 shows a light emission drive pattern based on the pixel data conversion table of selective erasure addressing and pixel drive data GD that is obtained by means of this pixel data conversion table;

DETAILED DESCRIPTION OF THE INVENTION

Figure 1:
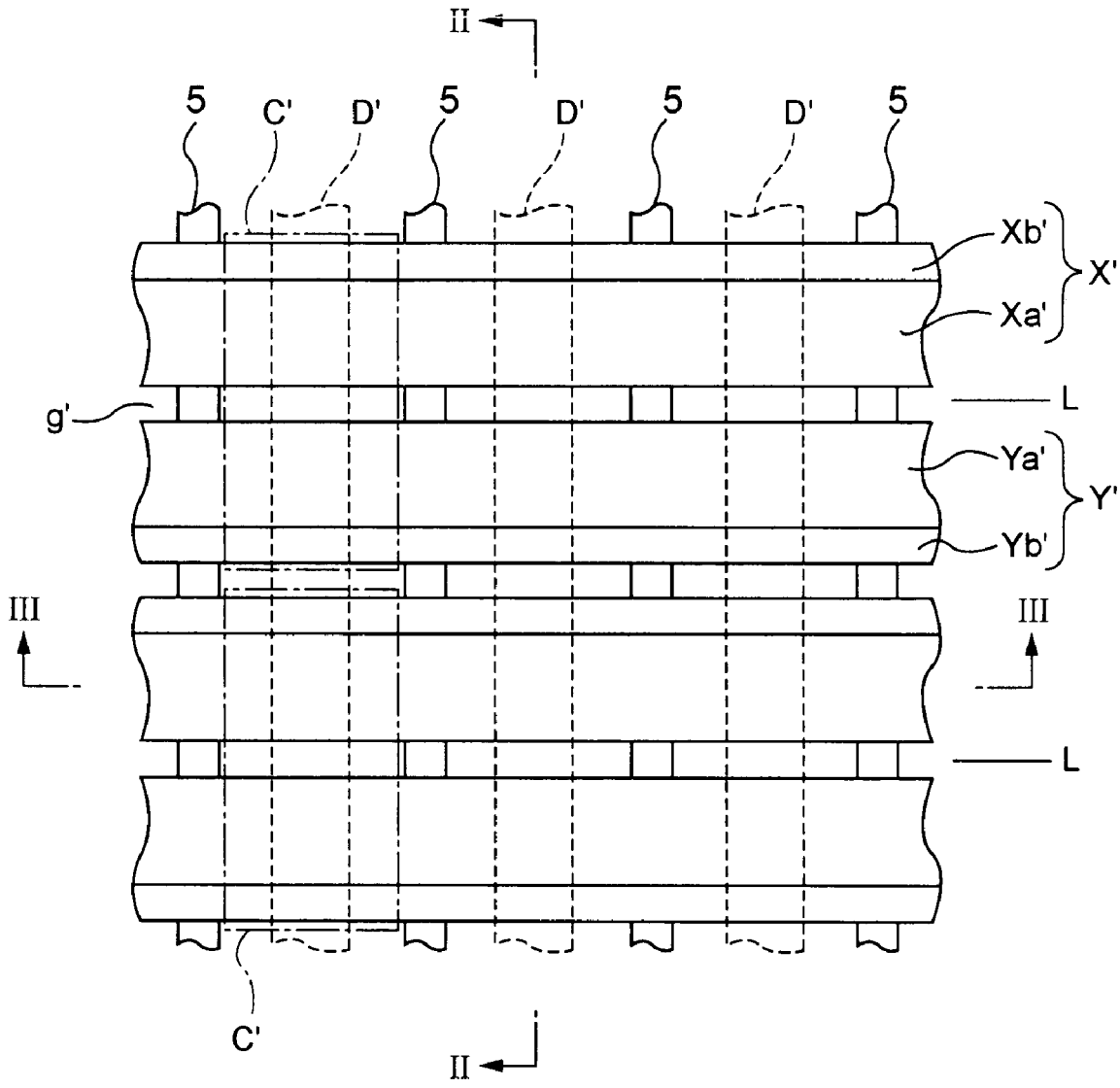
FIG. 1 is a planar view of part of the structure of a conventional PDP, as seen from the display face side.
Figure 2:
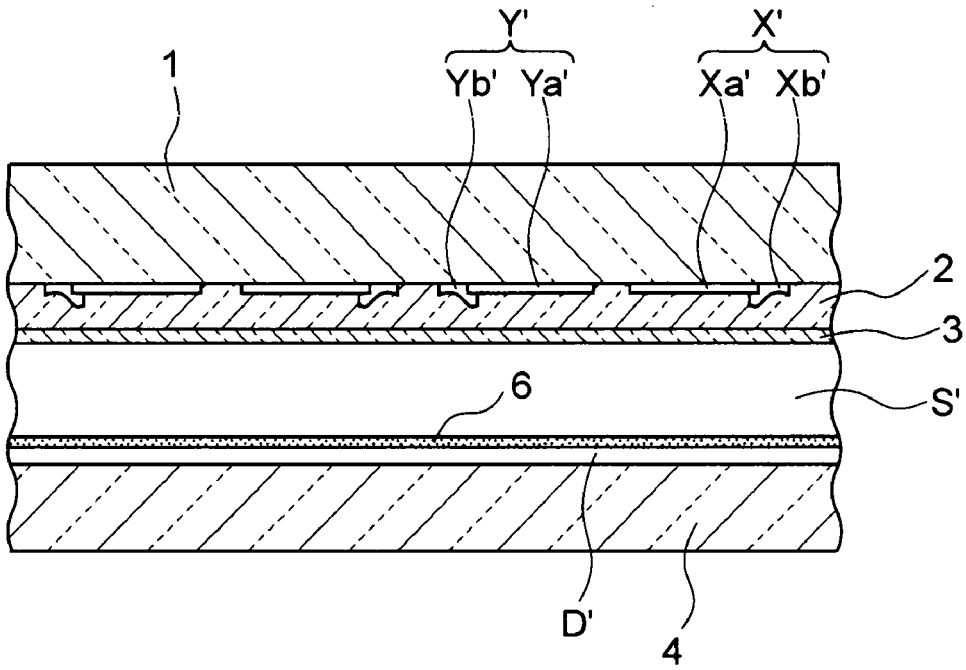
FIG. 2 shows a cross-section of the PDP along the line II—II shown in FIG. 1.
Figure 3:
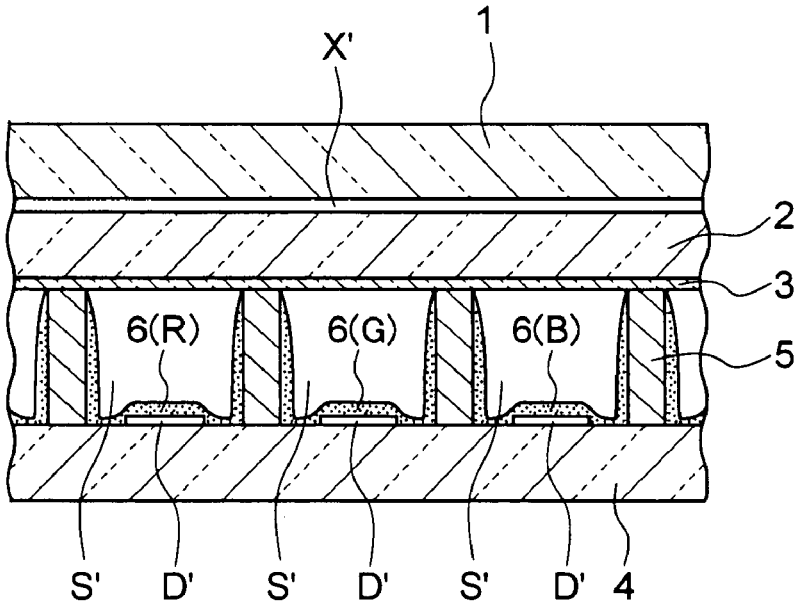
FIG. 3 shows a cross-section of the PDP along the line III—III shown in FIG. 1.
Figure 4:
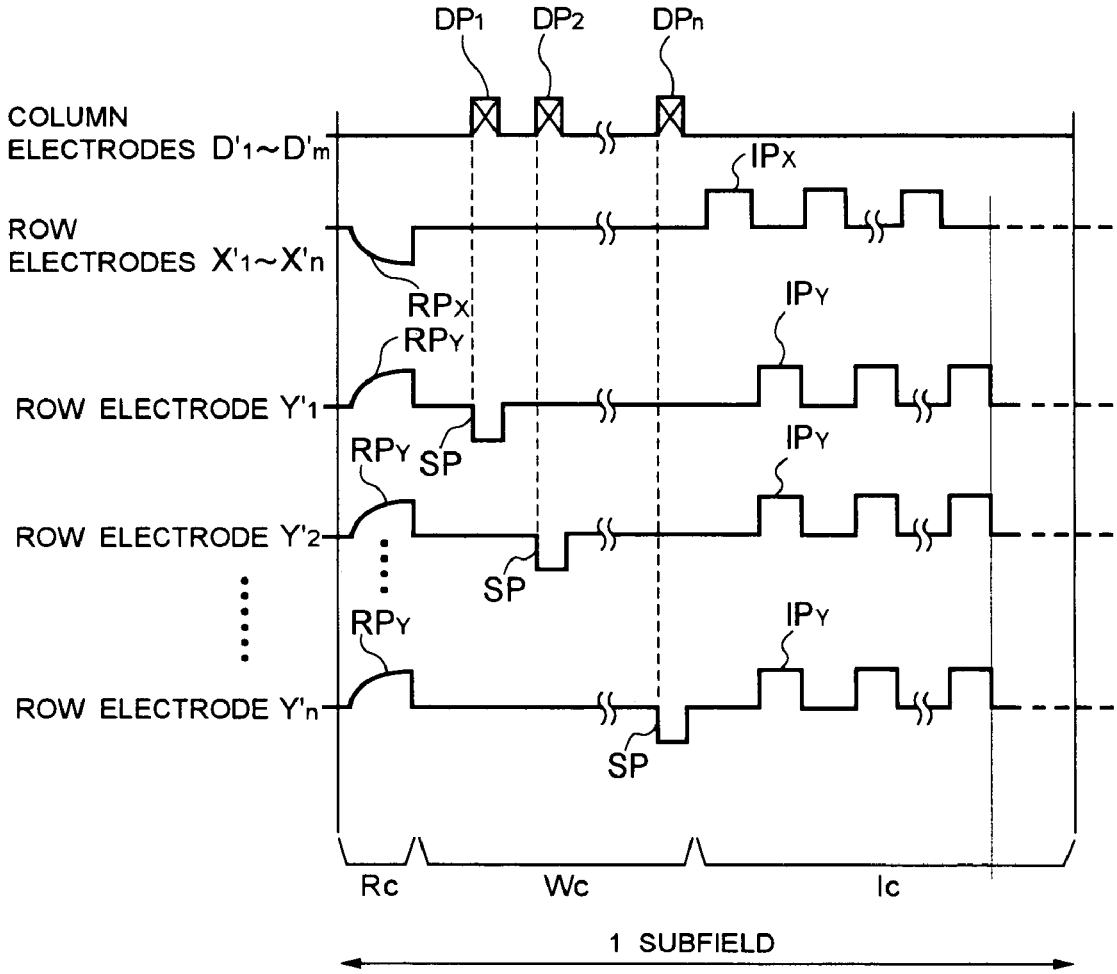
FIG. 4 shows a variety of drive pulses applied to the PDP and the application timing thereof.
Figure 5:
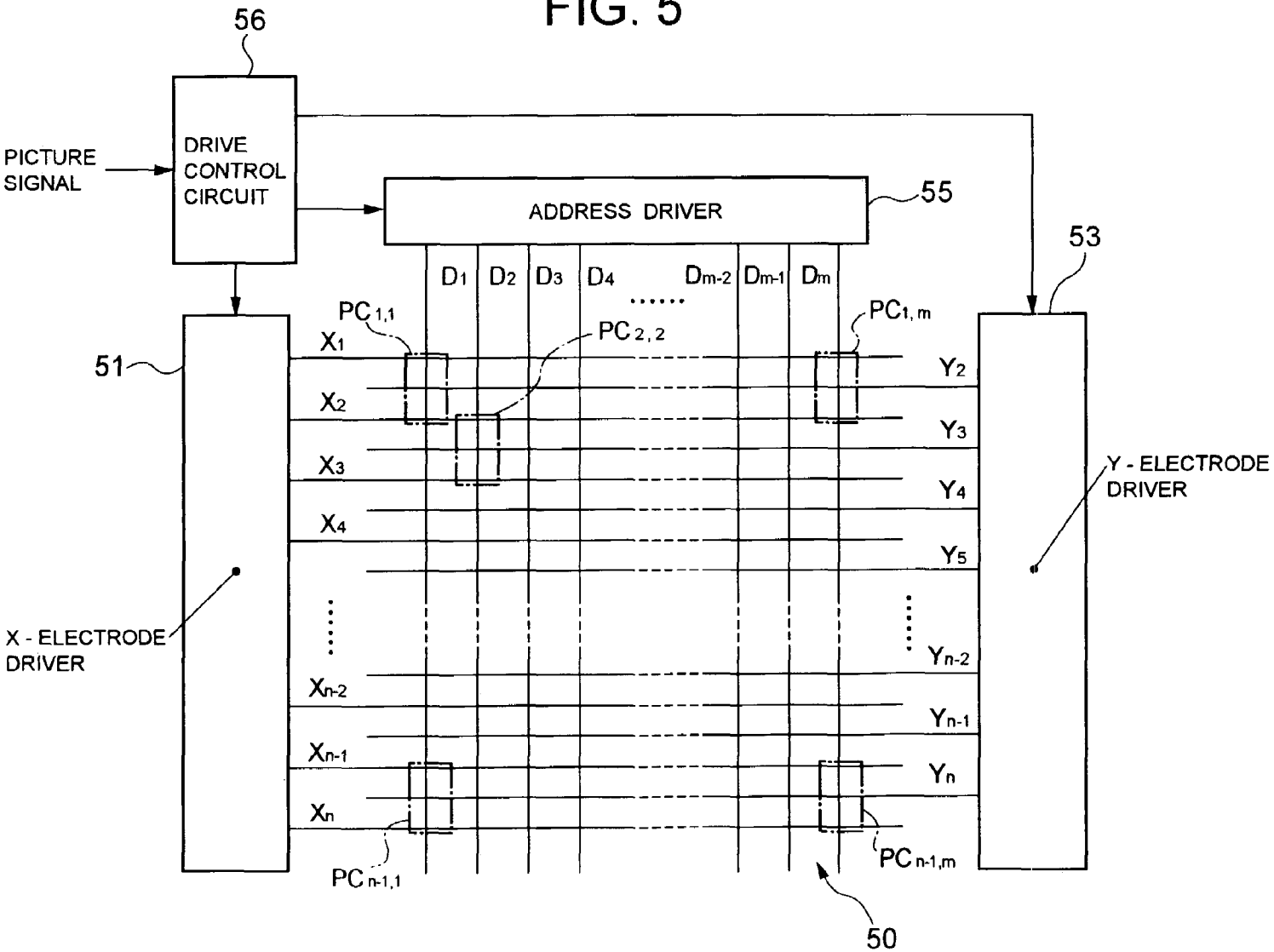
FIG. 5 generally shows the structure of the plasma display device to which the present invention is applied.

FIG. 5 shows the structure of the plasma display device constituting the display device of the present invention.

As shown in FIG. 5, this plasma display device is constituted by a PDP 50 constituting a plasma display panel, an X electrode driver 51, a Y electrode driver 53, an address driver 55, and a drive control circuit 56.

Belt-shaped column electrodes $D_1$ to $D_m$ that each extend in the vertical direction of the display screen are formed in the PDP 50. Further, belt-shaped column electrodes $X_1$ to $X_n$ and row electrodes $Y_2$ to $Y_n$, which each extend in the horizontal direction of the display screen, are formed in the PDP 50 so as to be arranged alternately and in numerical order as shown in FIG. 5. A pair of row electrodes, that is, the row electrode pairs ($X_2$, $Y_2$) to row electrode pairs ($X_n$, $Y_n$), bear the first to (n-1) th display lines of the PDP 50. Pixel cells PC carrying pixels are formed at the intersections between the display lines and column electrodes $D_1$ to $D_m$ (the regions enclosed by dot-chain lines in FIG. 5). That is, the PDP 50 has a matrix-like arrangement of pixel cells $PC_{1,1}$ to $PC_{1,m}$ belonging to the first display line, pixel cells $PC_{2,1}$ to $PC_{2,m}$, . . . belonging to the second display line, and pixel cells $PC_{n-1,1}$ to $PC_{n-1,m}$ belonging to the (n-1)th display line.

FIGS. 6 to 9 afford views in which part of the internal structure of the PDP 50 is removed.

Figure 6:
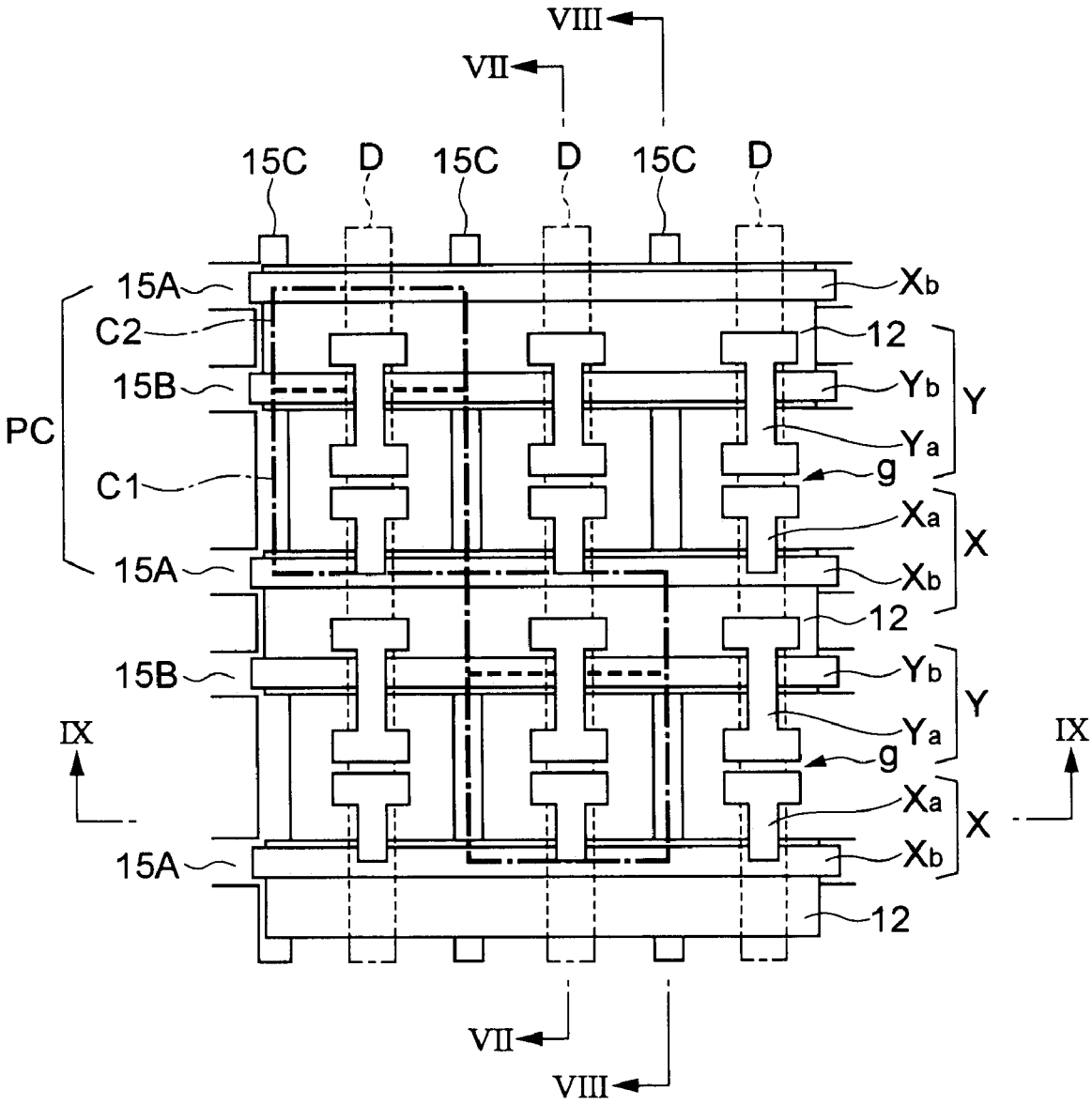
FIG. 6 is a plan view of part of the structure of the PDP in the device in FIG. 5, as seen from the display face side.
Figure 7:
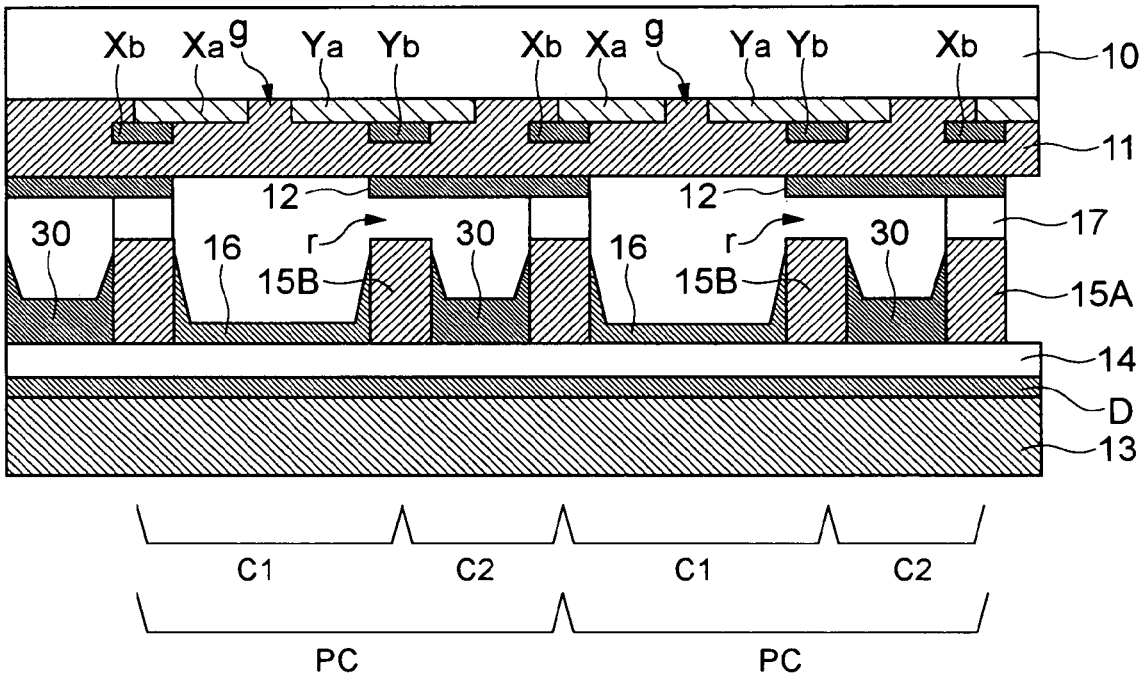
FIG. 7 shows a cross-section of the PDP along the line VII—VII shown in FIG. 6.
Figure 8:
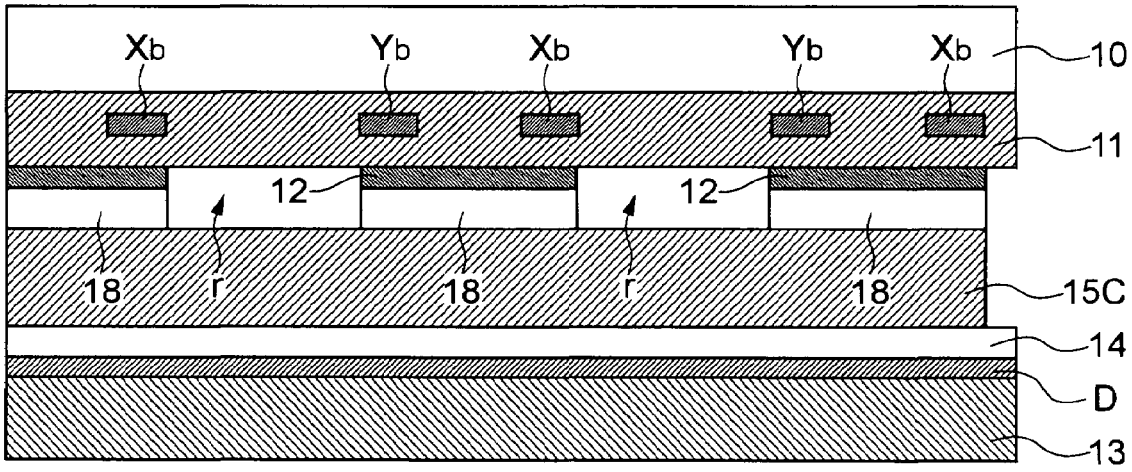
FIG. 8 shows a cross-section of the PDP along the line VIII—VIII shown in FIG. 6.
Figure 9:
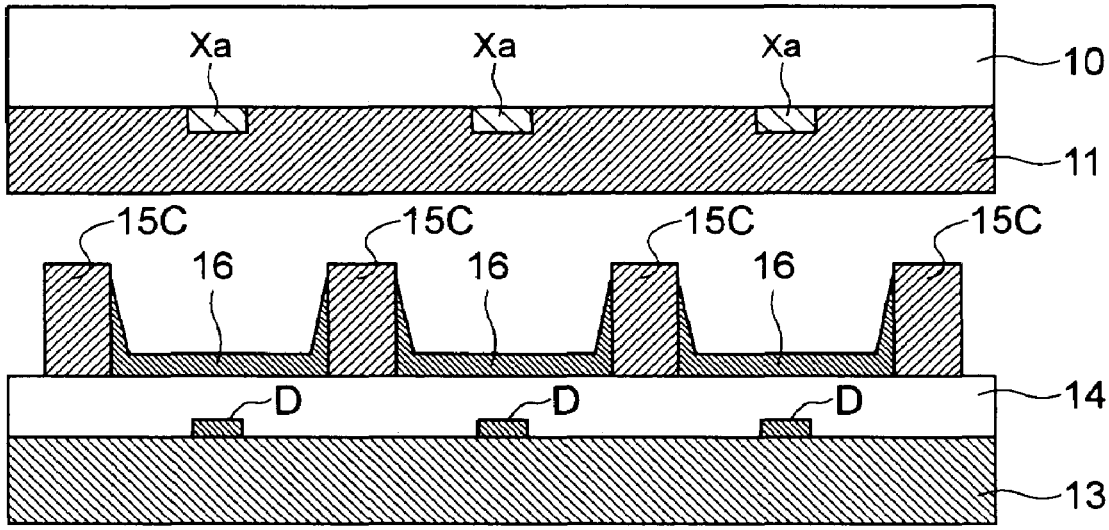
FIG. 9 shows a cross-section of the PDP along the line IX—IX shown in FIG. 6.

Further, FIG. 6 is a planar view of the PDP 50 as seen from the display face side. FIG. 7 shows a cross-section of the PDP 50 along the line VII—VII shown in FIG. 6; FIG. 8 shows a cross-section of the PDP 50 along the line VIII—VIII shown in FIG. 6; and FIG. 9 shows a cross-section of the PDP 50 along the line IX—IX shown in FIG. 6.

As shown in FIG. 6, the row electrodes Y are each constituted by a belt-shaped bus electrode Yb (the main body portion of the row electrode Y) that extends in the horizontal direction of the display screen and by a plurality of transparent electrodes Ya connected to the bus electrodes Yb. The bus electrodes Yb consist of a black metal layer film, for example. The transparent electrodes Ya consist of an ITO or other transparent electrically conductive film, and are each arranged in positions corresponding with column electrodes D on the bus electrode Yb. The transparent electrodes Ya extend in a direction orthogonal to the bus electrodes. Yb, the first and second ends of the transparent electrodes Ya being formed wide as shown in FIG. 6. That is, the transparent electrodes Ya can be perceived as protruding electrodes that protrude from the main body portion of the row electrodes Y. Further, the row electrodes X are each constituted by a belt-shaped bus electrode Xb (the main body portion of the row electrodes X) that extends in the horizontal direction of the display screen, and a plurality of transparent electrodes Xa connected to the bus electrodes Xb. The bus electrodes Xb consist of a black metal film, for example. The transparent electrodes Xa consist of an ITO or other transparent electrically conductive film and are all arranged in positions corresponding with column electrodes D on the bus electrodes Xb. The transparent electrodes Xa extend in a direction orthogonal to the bus electrodes Xb, the ends of the transparent electrodes Xa having a wide shape as shown in FIG. 6. In other words, the transparent electrodes Xa can be perceived as protruding electrodes that protrude from the main body portions of the row electrodes X. The wide portions of the transparent electrodes Xa and Ya are arranged facing each other via a discharge gap g of a predetermined width as shown in FIG. 6. In other words, the transparent electrodes Xa and Ya, which constitute protruding electrodes that protrude from the main body portions of the row electrodes X and Y that form pairs, are arranged facing each other via the discharge gap g.

The row electrodes Y consisting of the transparent electrodes Ya and bus electrodes Yb, and the row electrodes X consisting of the transparent electrodes Xa and bus electrodes Xb are formed in the rear face of the front face glass substrate 10 that carries the display face of the PDP 50 as shown in FIG. 7. In addition, the dielectric layer 11 is formed in the rear face of the front face glass substrate 10 so as to cover the row electrodes X and Y. Raised dielectric layers 12, which protrude from the dielectric layer 11 toward the rear face side, are formed in positions corresponding to the controlled discharge cells C2 (described later) in the surface of the dielectric layer 11. The raised dielectric layer 12 consists of a belt-shaped light absorption layer containing a black or dark-colored colorant, and is formed extending in the horizontal direction of the display face as shown in FIG. 6. The surface of the raised dielectric layer 12 and the surface of the dielectric layer 11 on which the raised dielectric layer 12 is not formed is covered by a protective layer (not shown) consisting of MgO (magnesium oxide). The plurality of column electrodes D that extend in a direction (vertical direction) orthogonal to both the bus electrodes Xb and Yb is arranged in parallel and spaced apart by predetermined intervals on a rear face substrate 13 that is disposed parallel to the front face glass substrate 10. A white column electrode protective layer (dielectric layer) 14 that covers the column electrodes D is formed on the rear face substrate 13. Barrier walls 15 each consisting of a first lateral wall 15A, a second lateral wall 15B, and a vertical wall 15C are formed on the column electrode protective layer 14. The first lateral walls 15A are formed extending in the horizontal direction of the display face in positions on the column electrode protective layer 14 facing the bus electrodes Yb. The second lateral walls 15B are formed extending in the horizontal direction of the display face in positions on the column electrode protective layer 14 facing the bus electrodes Xb. The vertical walls 15C are formed extending in a direction orthogonal to each of the bus electrodes (Xb (Yb) in positions between the transparent electrodes Xa (Ya) arranged at equal intervals on the bus electrodes Xb (Yb).

Furthermore, as shown in FIG. 7, secondary electron discharge material layers 30 are formed in regions (including the sides of the vertical walls 15C, first lateral walls 15A and second lateral walls 15B) that face the raised dielectric layers 12 on the column electrode protective layer 14. The secondary electron discharge material layer 30 is a layer consisting of material of height ã with a low work function (equal to or less than 4.2 e, for example), and a high so-called secondary electron discharge coefficient. Materials that are used as the secondary electron discharge material layer 30 include, for example, alkali earth metal oxides such as MgO, CaO, SrO, and BaO; alkali metal oxides such as $Cs_2O$; $CaF_2$, $MgF_2$ or other fluorides; $TiO_2$, $Y_2O_3$, or materials whose secondary electron discharge coefficient has been raised by means of crystal defects and doping with impurities, diamond-shaped thin films, and carbon nanotubes and so forth. Meanwhile, phosphor layers 16 are formed as shown in FIG. 7 in regions (including the sides of the vertical walls 15C, first lateral walls 15A and second lateral walls 15B) outside the regions facing the raised dielectric layers 12 on the column electrode protective layer 14. As the phosphor layer 16, there is a tri-system consisting of a red phosphor layer for emitting red light, a green phosphor layer for emitting green light, and a blue phosphor layer for emitting blue light, the allocation of this tri-system being decided for every pixel cell PC. A discharge space in which a discharge gas is enclosed exists between the secondary electron discharge material layer 30 and phosphor layer 16, and the dielectric layer 11. The respective heights of the first lateral wall 15A, second lateral wall 15B, and vertical wall 15C is not so high as to reach the surface of the raised dielectric layers 12 or dielectric layer 11 as shown in FIGS. 7 and 9. Accordingly, gaps r, which allow discharge gas to pass, exist between the second lateral walls 15B and the raised dielectric layers 12 as shown in FIG. 7. Dielectric layers 17, which extend in a direction following the first lateral walls 15A and serving to prevent discharge interference, are formed between the first lateral walls 15A and raised dielectric layers 12. Further, a dielectric layer 18 is formed continuously between the vertical walls 15C and raised dielectric layers 12 in a direction following the vertical walls 15C as shown in FIG. 8.

Here, regions enclosed by the first lateral walls 15A and vertical walls 15C (regions enclosed by dot-chain lines in FIG. 6) are pixel cells PC that carry pixels. In addition, the pixel cells PC as shown in FIGS. 6 and 7 are divided into display discharge cells C1 and controlled discharge cells C2 by the second lateral walls 15B. As shown in FIGS. 6 and 7, the display discharge cells C1 each comprise a pair of row electrodes X and Y that carry a display line, and the phosphor layers 16. Meanwhile, the controlled discharge cells C2 comprise the row electrodes Y in the pair of row electrodes carrying the display line, the row electrodes X in the pair of row electrodes carrying the adjoining display lines above the display face of the display lines; the raised dielectric layers 12, and the secondary electron discharge material layers 30. Further, within the display discharge cells C1, as shown in FIG. 6, wide portions, which are formed at the respective first ends of the transparent electrodes Xa of the row electrodes X, and wide portions, which are formed at the respective first ends of the transparent electrodes Ya of the row electrodes Y, are arranged facing each other via the discharge gap g. Meanwhile, although wide portions formed at the other respective ends of the transparent electrodes Ya are included in the controlled discharge cells C2, the transparent electrodes X are not included therein.

Further, as shown in FIG. 7, the respective discharge spaces of the pixel cells PC adjoining one another in the vertical direction (lateral direction in FIG. 7) of the display face are shielded by the first lateral walls 15A and dielectric layers 17. However, the respective discharge spaces of the display discharge cells C1 and controlled discharge cells C2 belonging to the same pixel cells PC are linked by the gaps r as shown in FIG. 7. In addition, although the respective discharge spaces of the controlled discharge cells C2 that adjoin one another in the lateral direction of the display face are blocked by the raised dielectric layers 12 and dielectric layers 18 as shown in FIG. 8, the respective discharge spaces of the display discharge cells C1 that adjoin one another in the lateral direction of the display face are linked to each other.

Thus, the pixel cells $PC_{1,1}$ to $PC_{n-1,m}$ formed in the PDP 50 are constituted by the display discharge cells C1 and controlled discharge cells C2 whose discharge spaces are linked to one another.

The X electrode driver 51 applies a variety of drive pulses to each of the row electrodes $X_1$, $X_2$, $X_3$, $X_4$, $X_5$, . . . , $X_{n-1}$ and $X_n$ of the PDP 50 in accordance with a timing signal supplied from the drive control circuit 56. The electrode driver 53 applies a variety of drive pulses to each of the row electrodes $Y_2$, $Y_3$, $Y_4$, $Y_5$, . . . , $Y_{n-1}$ and $Y_n$ of the PDP 50 in accordance with a timing signal supplied from the drive control circuit 56. The address driver 55 applies a pixel data pulse to the column electrodes $D_1$ to $D_m$ of the PDP 50 in accordance with the timing signal supplied from the drive control circuit 56.

The drive control circuit 56 first converts the input picture signal into 8-bit pixel data, for example, that expresses the luminance level for each pixel, and error diffusion processing and dither processing are likewise performed with respect to the pixel data. For example, in the error diffusion processing, the upper six bits' worth of the pixel data is the display data, and the remaining lower two bits' worth of the pixel data are the error data. Further, data produced by adding a weighting to the respective error data of the pixel data corresponding with the surrounding pixels is reflected in the display data. As a result of this operation, the luminance corresponding to the lower two bits of the original pixels is pseudo-represented by the surrounding pixels, and so, by means of display data corresponding to less than eight bits, i.e. six bits, luminance grayscale representation that is the same as that for eight bits' worth of pixel data is feasible. Further, dither processing is performed on six-bit error diffusion processing pixel data obtained by this error diffusion processing. In dither processing, a plurality of pixels that adjoin one another form a single pixel unit and dither-added pixel data that is added by separately allocating a dither coefficient consisting of different coefficient values to each of the error diffusion processing pixel data corresponding with pixels in this single pixel unit. As a result of the addition of those dither coefficients, when seen as a single pixel unit, it is also possible to represent luminance equivalent to eight bits with only the upper four bits' worth of the dither-added pixel data.

The drive control circuit 56 converts eight-bit pixel data into four bit multi-tone pixel data PDs by means of error diffusion processing and dither processing, and converts this multi-tone pixel data PDs into fifteen-bit pixel drive data GD in accordance with the data conversion table as shown in FIG. 10. As a result, the pixel data that is capable of representing 256 gray levels by means of eight bits is wholly converted into fifteen-bit pixel drive data GD consisting of sixteen patterns. Next, the drive control circuit 56 obtains pixel drive data bit groups DB1 to DB15 by dividing this pixel drive data $GD_{1,1}$ to $GD_{(n-1),m}$ by equal bit columns for each of the pixel drive data $GD_{1,1}$ to $GD_{(n-1),m}$ corresponding to a single screen. For each of subfields SF1 to SF15, the drive control circuit 56 supplies data bits in the pixel drive data bit groups DB corresponding with these subfields to the address driver 55 in an amount corresponding to one display line (m display lines) at a time.

Figure 11:
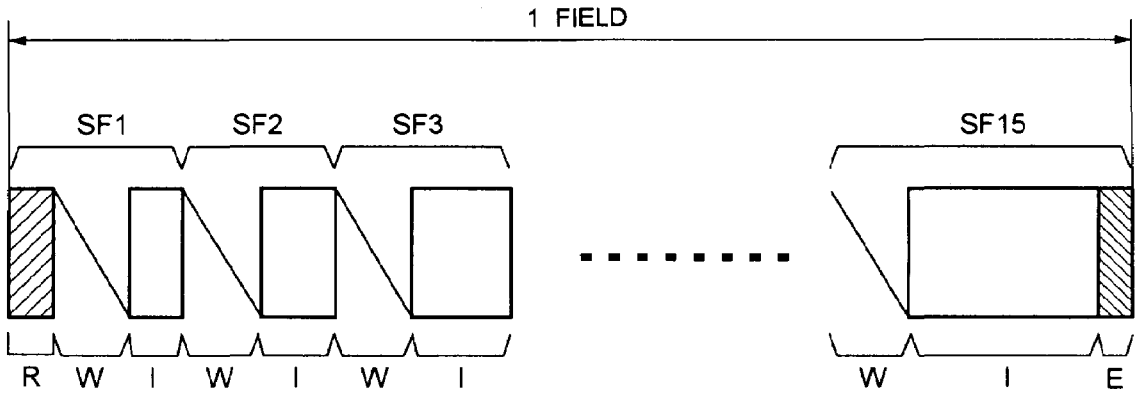
FIG. 11 shows an example of a light emission drive sequence during driving by means of selective erasure addressing.

FIG. 11 shows a light emission drive sequence during halftone-driving of the PDP 50 by applying selective erasure addressing.

In the light emission drive sequence shown in FIG. 11, the fields in the picture signal are divided into fifteen subfields SF1 to SF15, and an address path length W and a light emission hold path length I in each subfield are implemented. Further, in the header subfield SF1, a batch reset path length R that precedes the address path length W is implemented, while, in the ultimate subfield SF15, the erasure path length E is implemented immediately after the light emission hold path length I.

Figure 12:
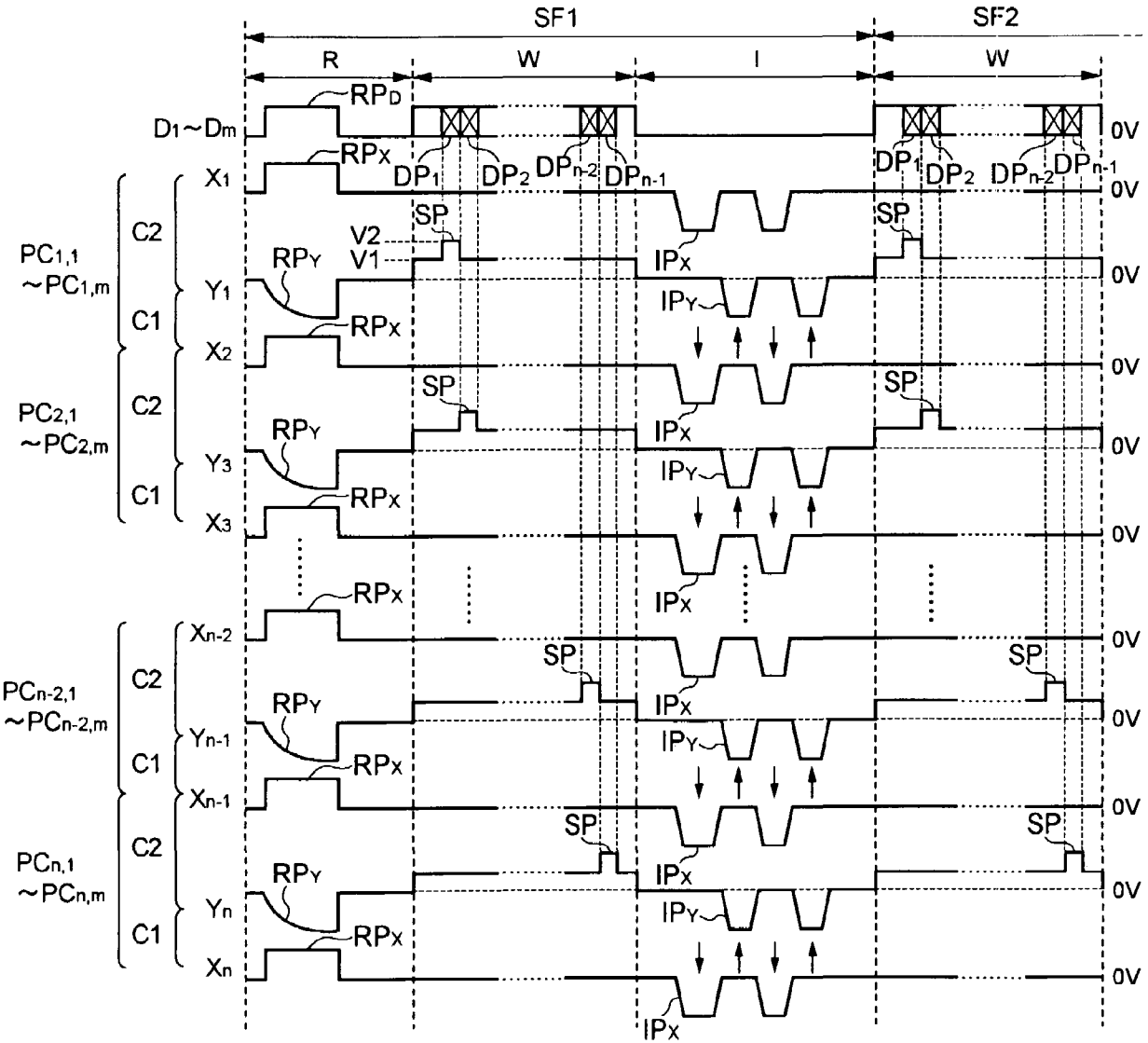
FIG. 12 shows a variety of drive pulses applied to the PDP in partial cycles of the subfields SF1 and SF2 of the device in FIG. 5, as well as the drive pulse application timing.

FIG. 12 shows a variety of drive pulses applied to the PDP 50 by the X electrode driver 51 and the Y electrode driver 53 by means of the batch reset path length R, the address path length W, and the light emission hold path length I, in accordance with the light emission drive sequence shown in FIG. 11. Further, FIG. 12 provides a view in which only part of the header subfield SF1 and the following subfield SF2 is removed.

First of all, in the batch reset path length R, the Y electrode driver 53 generates a negative reset pulse $RP_Y$ whose trailing edge variation is more gradual than that of the sustain pulse described subsequently and simultaneously applies this negative reset pulse $RP_Y$ to the row electrodes $Y_2$ to $Y_n$ of the PDP 50. Further, using timing that is the same as that for this reset pulse $RP_Y$, the X electrode driver 51 generates a positive reset pulse $RP_x$ and simultaneously applies same to the row electrodes $X_1$ to $X_n$ of the PDP 50. Meanwhile, the address driver 55 generates a positive reset pulse $RP_D$ and simultaneously applies same to the column electrodes $D_1$ to $D_m$ of the PDP 50. In accordance with this application of the reset pulses $RP_D$, $RP_Y$, and $RP_x$, a reset discharge (write discharge) occurs between the column electrodes D and the row electrodes Y in the controlled discharge cells C2 of all the pixel cells PC of the PDP 50, and a wall charge is thus formed in these controlled discharge cells C2. Further, as a result of this application of the reset pulses $RP_D$, $RP_Y$, and $RP_x$, the column electrode D-side is the anode relative to the row electrodes X and Y. Further, the reset discharge shifts toward the display discharge cells C1 via the gap r shown in FIG. 7, thereby provoking a discharge between the row electrodes Y and X in the display discharge cells C1. As a result of this discharge shift, a wall charge is formed in the display discharge cells C1 of all the image cells PC.

As described above, in the batch reset path length R based on the selective erasure addressing, a wall charge is formed in the display discharge cells C1 of all the pixel cells PC of the PDP 50, and these pixel cells PC are all initialized in lit cell mode.

Next, in the address path length W, the Y electrode driver 53 applies a positive voltage V1 to all the row electrodes $Y_2$ to $Y_n$, while a scan pulse SP with a positive voltage V2 (V2>V1) is sequentially applied to the row electrodes $Y_2$ to $Y_n$. Meanwhile, the X electrode driver 51 sets the row electrodes $X_1$ to $X_n$ to 0V. The address driver 55 converts the data bits in the pixel drive data bit groups DB1 corresponding with the subfield SF1 to a pixel data pulse DP having a pulse voltage corresponding with the logic level of each data bit. For example, the address driver 55 converts a logic level 0 pixel drive data bit to a positive high voltage pixel data pulse DP, while converting a logic level 1 pixel drive data bit to a low voltage (0 volt) pixel data pulse DP. Further, this pixel data pulse DP is applied to (m) column electrodes $D_1$ to $D_m$ corresponding to one display line at a time in sync with the application timing for the scan pulse SP. In other words, the address driver 55 first applies a pixel data pulse group $DP_1$ consisting of m pixel data pulses DP corresponding with a first display line to the column electrodes $D_1$ to $D_m$, and then a pixel data pulse group $DP_2$ consisting of m pixel data pulses DP corresponding with a second display line to the column electrodes $D_1$ to $D_m$ is applied. An erasure address discharge is produced between the column electrodes D and row electrodes Y in the controlled discharge cells C2 of the pixel cells PC to which the scan pulse SP having a positive voltage V2 and the low voltage (0 volt) pixel data pulse DP are simultaneously applied. Further, the discharge accompanying the erasure address discharge shifts toward the display discharge cells C1 via the gap r shown in FIG. 7 to provoke a discharge between the row electrodes Y and X in the display discharge cells C1. As a result of the discharge shift from the controlled discharge cells C2 to the display discharge cells C1 as described above, the wall charge formed in the display discharge cells C1 disappears. Meanwhile, although the scan pulse SP is applied, the erasure address discharge as described above is not produced in the control discharge cells C2 of the pixel cells PC to which the high voltage pixel data pulse DP is applied. Accordingly, because the discharge shift from the controlled discharge cells C2 to the display discharge cells C1 as described above is also not generated, the formed state of the wall charge in the display discharge cells C1 also retains the existing state. In other words, when there is a wall charge in the display discharge cells C1, this state remains unchanged, and when the wall charge is not present, the unformed state of this wall charge is retained.

Therefore, in the address path length W based on the selective erasure addressing, an erasure address discharge is selectively produced in the controlled discharge cells C2 of the pixel cells PC in accordance with the data bits of the pixel drive data bit group corresponding with the subfield, whereby the wall charge is erased. As a result, the pixel cells PC in which the wall charge remains are set to the lit cell mode, and the pixel cells PC in which the wall charge is erased are set to the unlit cell mode.

Next, in the sustain path length I, the X electrode driver 51 repeatedly applies a negative sustain pulse $IP_x$ to the row electrodes $X_1$ to $X_n$ and the Y electrode driver 53 repeatedly applies the negative sustain pulse $IP_Y$ to the row electrodes $Y_2$ to $Y_n$. The sustain pulse is alternately applied to the row electrodes $X_1$ to $X_n$ and the row electrodes $Y_2$ to $Y_n$. The number of repetitions is equal to the number allocated to the subfield to which the sustain path length I belongs. When the sustain pulse $IP_x$ or $IP_Y$ is applied, a sustain discharge is produced between the transparent electrodes Xa and transparent electrodes Ya in the display discharge cells C1 of the pixel cells PC which have been set to lit cell mode. FIG. 12 shows the directions of the discharge currents of the sustain discharge by means of arrows. The phosphor layers 16 (red phosphor layer, green phosphor layer, and blue phosphor layer) formed in the display discharge cells C1 as shown in FIG. 7 are excited by the ultraviolet rays generated by the sustain discharge, whereby light corresponding with the fluorescent colors of these layers is irradiated via the front face glass substrate 10. In other words, the light emission accompanying this sustain discharge is repeatedly brought about the number of times allocated to the subfield to which the sustain path length I belongs.

A negative wall charge is formed in the column electrode D-side discharge space in the display discharge cells C1 of the pixel cells PC which have been set to the lit cell mode, as a result of the application of the negative sustain pulses $IP_x$, $IP_Y$. Each sustain path length I is compulsorily terminated by the application of the sustain pulse $IP_Y$ to the row electrodes $Y_2$ to $Y_n$. Due to this termination of the sustain path length I, a positive wall charge is formed in the discharge space on the side of the row electrodes $Y_2$ to $Y_n$. Accordingly, the wall charge state at the end of the address path length W of the subfield is formed in the display discharge cells C1.

As shown in FIG. 12, when the shift is made from the subfield SF1 to the next subfield SF2, the address path length W is started immediately. As described above, while the Y electrode driver 53 applies the positive voltage V1 to all the row electrodes $Y_2$ to $Y_n$, the scan pulse SP with a positive voltage V2 (V2>V1) is sequentially applied to the row electrodes $Y_2$ to $Y_n$. Meanwhile, the X electrode driver 51 sets the row electrodes $X_1$ to $X_n$ to 0V. The address driver 55 converts the data bits in the pixel drive data bit group DB1 that corresponds with the subfield SF1 to the pixel data pulses DP with a pulse voltage corresponding with the logic level, and the pixel data pulse DP is applied to (m) column electrodes $D_1$ to $D_m$ corresponding to one display line at a time in sync with the application timing for the scan pulse SP.

The formed state of the wall charge in the display discharge cells C1 at the end of the sustain path length I of the subfield SF1 is the state at the end of the address path length W of the subfield SF1, and hence the discharge shift from the control discharge cells C2 to the display discharge cells C1 when the address path length W in the subfield SF2 is started is not required. Accordingly, in the address path length W of the subfield SF2, an erasure address discharge is produced between column electrodes D and row electrodes Y in the control discharge cells C2 of the pixel cells PC to which the scan pulse SP having the positive voltage V2 and the low-voltage (0 volt) pixel data pulse DP are simultaneously applied. Then, the discharge accompanying the erasure address discharge shifts toward the display discharge cells C1 via the gap r shown in FIG. 7, whereby a discharge is produced between the row electrodes Y and X in the display discharge cells C1. As a result of the discharge shift from the control discharge cells C2 to the display discharge cells C1 in the address path length W of the subfield SF2, the wall charge formed in the subfield SF1 disappears in the display discharge cells C1. Meanwhile, although the scan pulse SP is applied, the erasure address discharge as described above is not produced in the control discharge cells C2 of the pixel cells PC to which the high voltage pixel data pulse DP is applied. Accordingly, because the discharge shift from the controlled discharge cells C2 to the display discharge cells C1 is also not generated in the address path length W of the subfield SF2, the formed state of the wall charge in the display discharge cells C1 also retains the existing state. In other words, when the wall charge following the cycle of the subfield SF1 is in the display discharge cells C1, this state remains unchanged, and when the wall charge is not present, the unformed state of this wall charge is retained.

The operation of the sustain path length of the subfield SF2 (not shown) and the operation of each path length of the subsequent subfield are the same as the operation of the address path length and sustain path length of the subfield SF1.

The drive of the batch reset path length R, the address path length W, and the sustain path length I as shown in FIGS. 11 and 12 is executed on the basis of the pixel drive data GD of 16 as shown in FIG. 10. According to the drive to which the selective erasure addressing is applied as shown in FIGS. 11 and 12, in subfields SF1 to SF15, the opportunity permitting the pixel cells PC to make the transition from the unlit cell mode to the lit cell mode is only provided in the batch reset path length R in the subfield SF1. Therefore, the erasure address discharge takes place in a single subfield among the subfields SF1 to SF15, and once the pixel cells PC are set to the unlit cell mode, these pixel cells PC cannot be reverted to the lit cell mode in subsequent subfields. Hence, according to the drive based on the pixel drive data GD of 16 as shown in FIG. 10, the pixel cells PC are set to the lit cell mode in each of the consecutive subfields in a proportion matching the luminance to be rendered. The sustain discharge light emission (denoted by a white circle) that follows in the sustain path length I of each subfield is implemented in the interval until the erasure address discharge (denoted by a black circle) is produced.

According to the drive as described above, the luminance corresponding to the total number of discharges occurring in a single field cycle is visualized. In other words, according to sixteen kinds of the light emission pattern produced by driving employing first to sixteenth grayscales as shown in FIG. 10, a halftone luminance corresponding to sixteen grayscales matching the total number of sustain discharges occurring in the subfields denoted by the white circles is implemented.

When driving based on the selective erasure addressing is performed as described above, when erasure address discharge is produced in the address path length W, the scan pulse SP having the positive voltage V2 is applied to the row electrodes Y and the low voltage (0 volt) pixel data pulse DP is applied to the column electrodes D. Because the column electrodes D in the controlled discharge cells C2 is at a lower potential than the row electrodes Y, the secondary electron discharge material layers 30 formed in the control discharge cells C2 is the cathode with respect to the row electrodes Y. Accordingly, when the erasure address discharge occurs, secondary electrons are favorably discharged from the secondary electron discharge material layers 30, and the erasure address discharge is thus reliably produced in the controlled discharge cells C2.

Moreover, in the above embodiment, grayscale drive rendering halftone luminance corresponding to (N+1) grayscales using N (fifteen in the embodiment) subfields was taken as an example and the operation thereof was described. However, this operation is also equally applicable to grayscale drive that renders halftone luminance corresponding to $2^N$ grayscales in N subfields.

Figure 13:
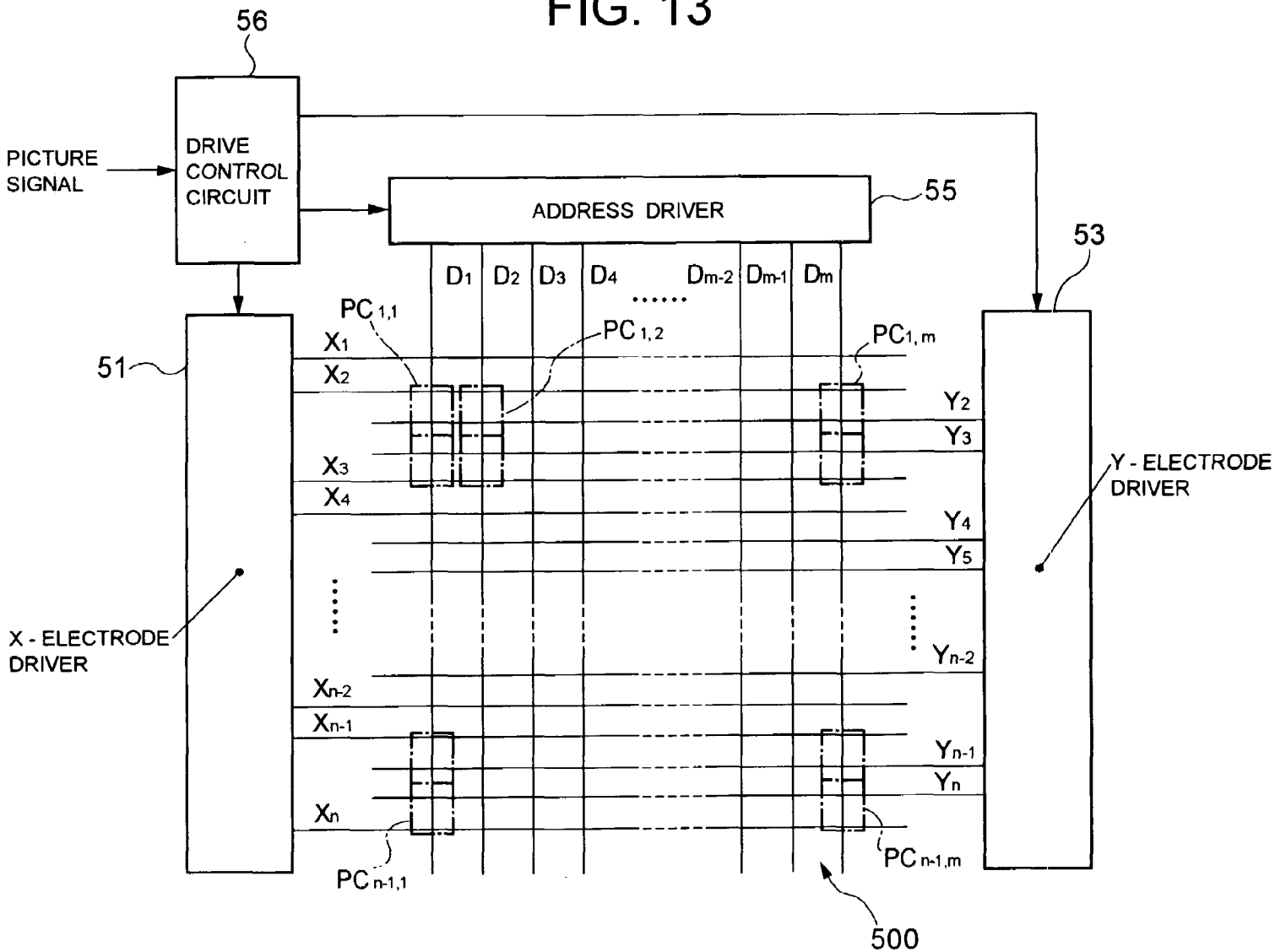
FIG. 13 shows another structure of another plasma display device to which the present invention is applied.

FIG. 13 shows the structure of a plasma display device constituting another embodiment of the present invention. The description for the device in FIG. 5 was for a case where a display panel in which the row electrodes X and Y carrying the display lines are arranged in an X, Y, X, Y arrangement. However, in the device in FIG. 13, a display panel is used in which the row electrodes X and Y are arranged in an X, X, Y, Y, X, X, Y, Y arrangement.

Instead of the PDP 50 shown in FIG. 5, the plasma display device in FIG. 13 adopts a PDP 500 in which the arrangement order for the row electrodes X and Y is X, X, Y, Y, X, X, Y, Y, the structure of the PDP 500 being otherwise the same as that shown in FIG. 5.

The PDP 500 is formed with belt-shaped column electrodes $D_1$ to $D_m$ that each extend in the vertical direction of the display screen. Further, belt-shaped column electrodes $X_1$ to $X_n$ and row electrodes $Y_2$ to $Y_n$, which each extend in the horizontal direction of the display screen, are formed in the PDP 500 so as to be arranged alternately and in numerical order. A pair of row electrodes, that is, the row electrode pairs ($X_2$, $Y_2$) to row electrode pairs ($X_n$, $Y_n$), bear the first to (n-1)th display lines of the PDP 500. Pixel cells PC carrying pixels are formed at the intersections between the display lines and column electrodes $D_1$ to $D_m$ (the regions enclosed by dot-chain lines in FIG. 16). That is, the PDP 50 has a matrix-like arrangement of pixel cells $PC_{1,1}$ to $PC_{1,m}$ belonging to the first display line, pixel cells $PC_{2,1}$ to $PC_{2,m}$, . . . , belonging to the second display line, and pixel cells $PC_{n-1,1}$ to $PC_{n-1,m}$ belonging to the (n-1)th display line.

Figure 14:
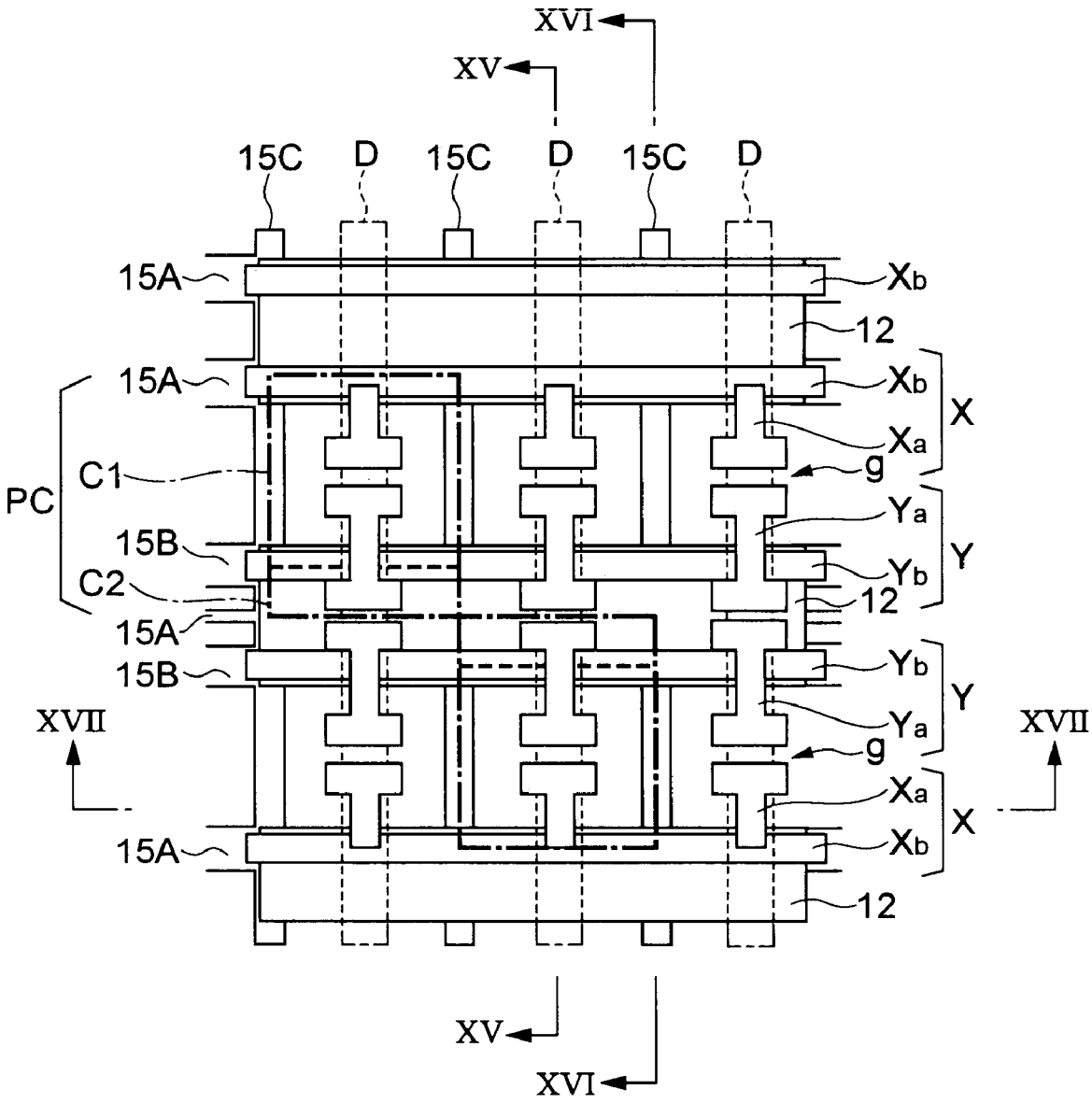
FIG. 14 is a planar view of part of the structure of the PDP in the device of FIG. 13, as seen from the display face side.
Figure 15:
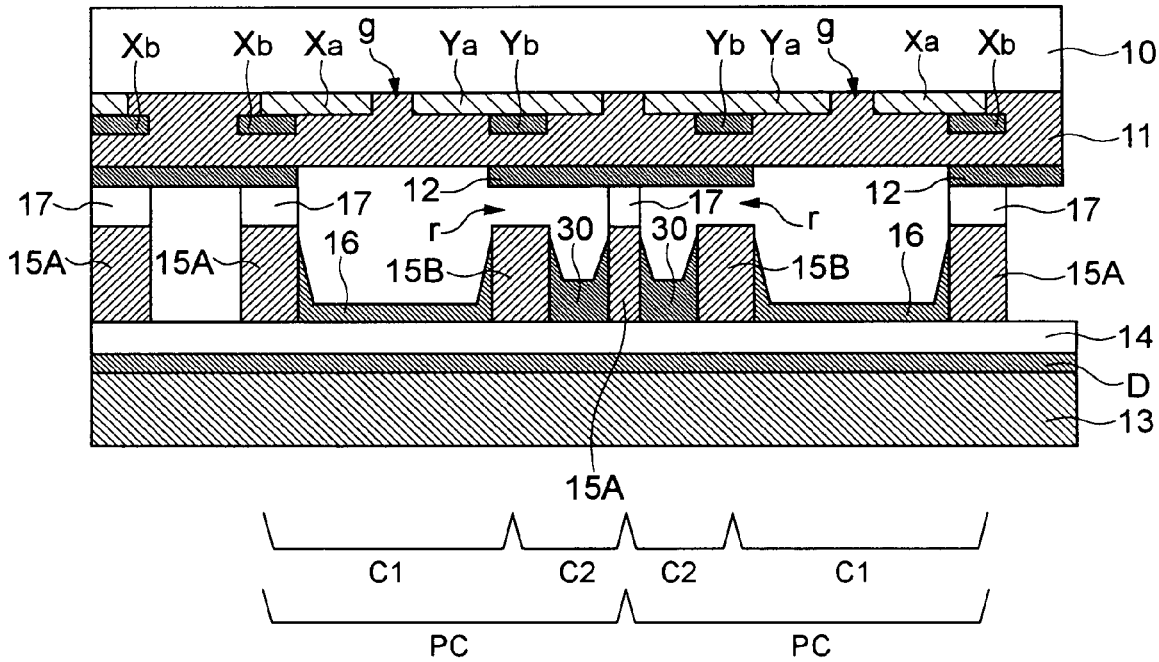
FIG. 15 shows a cross-section of the PDP along the line XV—XV shown in FIG. 14.
Figure 16:
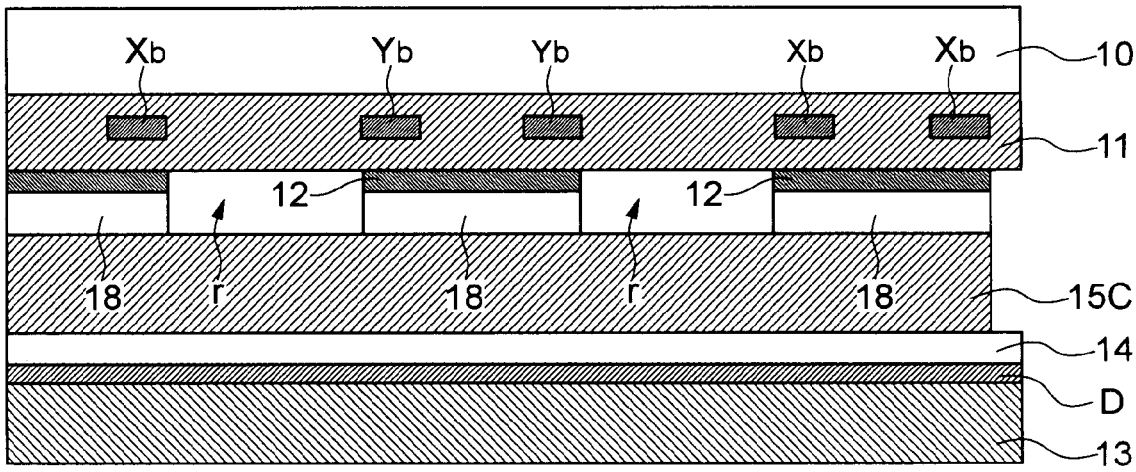
FIG. 16 shows a cross-section of the PDP along the line XVI—XVI shown in FIG. 14.
Figure 17:
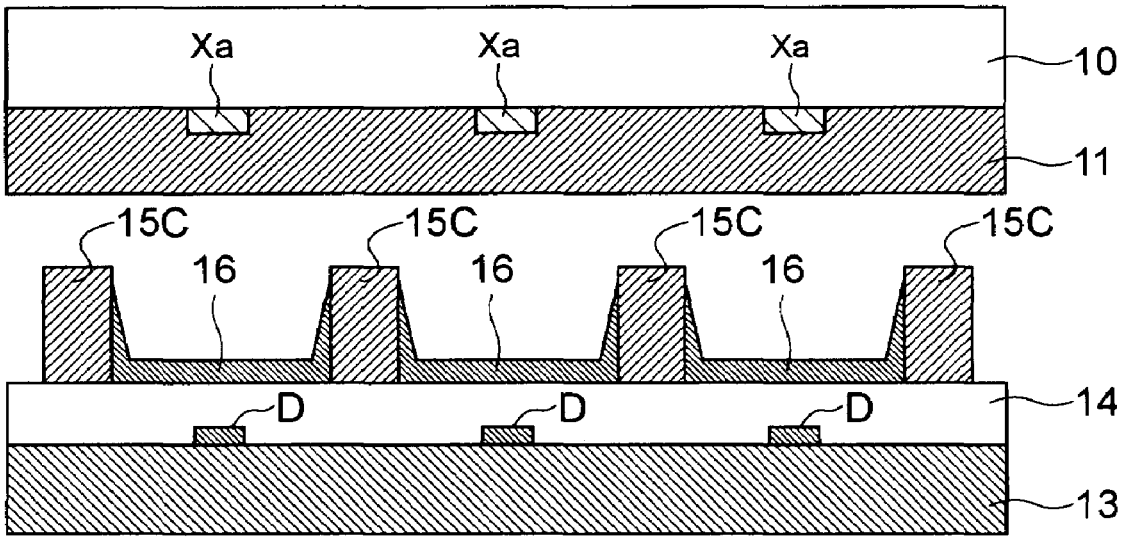
FIG. 17 shows a cross-section of the PDP along the line XVII—XVII shown in FIG. 14.

FIGS. 14 to 17 afford views in which part of the internal structure of the PDP 500 is removed. Further, FIG. 14 is a planar view showing the structure as seen from the display face side. FIG. 15 shows a cross-section as seen along the line XV—XV shown in FIG. 14; FIG. 16 shows a cross-section as seen along the line XVI—XVI; FIG. 17 shows a cross-section as seen along the line XVII—XVII shown in FIG. 14. In FIGS. 14 to 17, structural components assigned the same reference symbols as those shown in FIGS. 6 to 9 are the same.

That is, the PDP 500 is formed with a matrix-like arrangement of pixel cells PC consisting of a pair of discharge cells (the display discharge cells C1 and control discharge cells C2) that have a structure like that for the PDP 50. However, unlike the PDP 50, in the case of the PDP 500, the control discharge cells C2 of two pixel cells PC adjoining one another in the vertical direction of the screen are arranged adjoining one another. The discharge spaces of these adjoining controlled discharge cells C2 are shielded by the first lateral walls 15A and the dielectric layers 17 as shown in FIG. 15.

Figure 18:
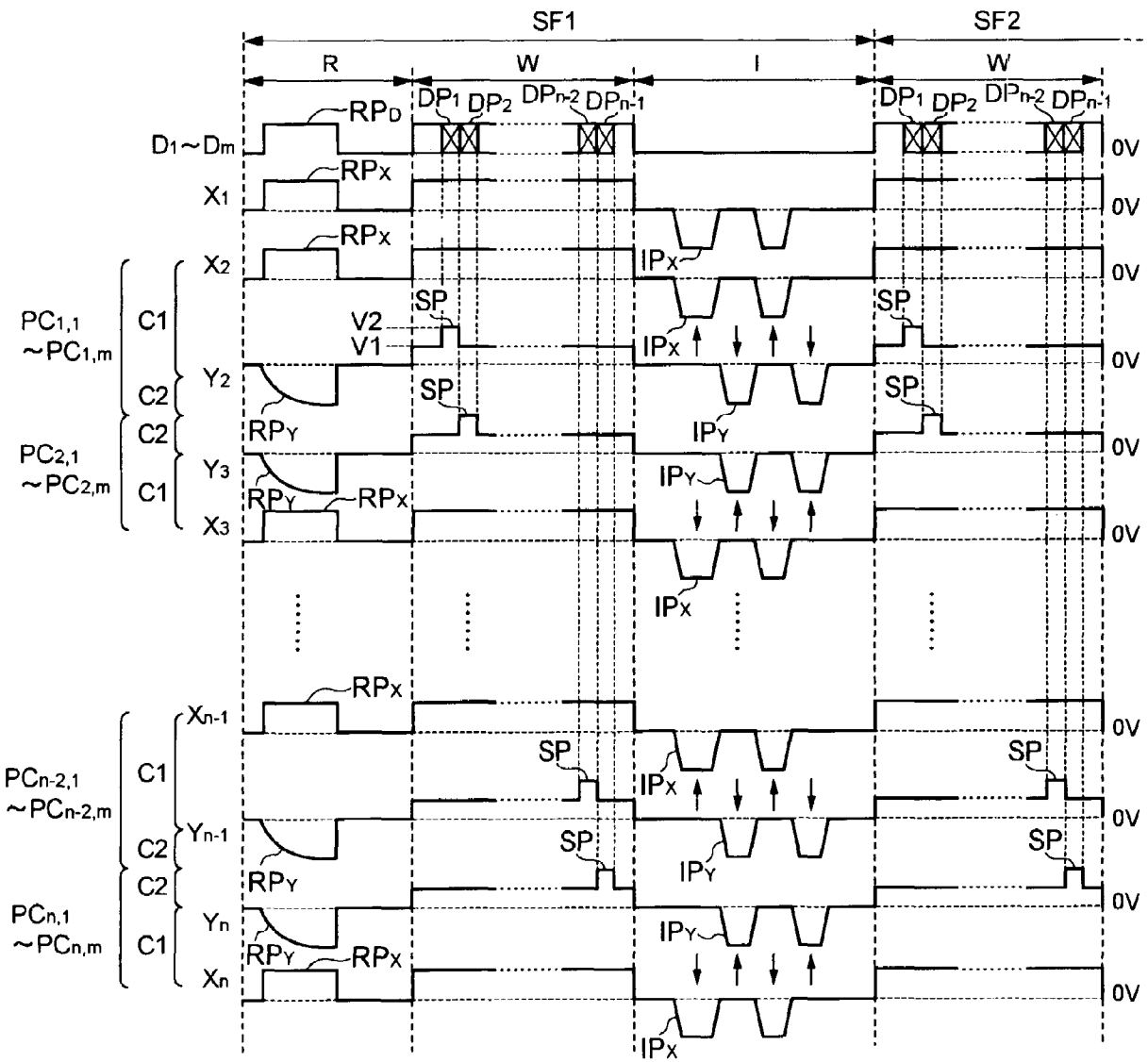
FIG. 18 shows a variety of drive pulses applied to the PDP in partial cycles of the subfields SF1 and SF of the device in FIG. 13 as well as the drive pulse application timing.

FIG. 18 shows a variety of drive pulses applied by both the X electrode driver 51 and Y electrode driver 53 to the PDP 500 when the PDP 500 is driven in accordance with the drive sequence as shown in FIGS. 10 and 11 for which selective erasure addressing is adopted.

In FIG. 18, the reset pulses RPx, $RP_Y$, and $RP_D$, which are applied in the batch reset path length R, the address path length W, and the sustain path length I, as well as the pixel data pulse DP, the scan pulse SP, and the sustain pulses $IP_x$ and $IP_Y$ are the same as those shown in FIG. 12. That is, the discharge brought about by the application of the variety of drive pulses, and the action that accompanies this discharge are the same as those described in FIG. 12. However, in the drive shown in FIG. 18, a predetermined positive voltage is applied rather than 0V to the X electrodes $X_1$ to $X_n$ in the address path length W. The predetermined positive voltage is a voltage at a level bringing about the shift toward the display discharge cells C1 via the gap r when the erasure address discharge occurs and bringing about the discharge between the row electrodes Y and X in the display discharge cells C1.

In the sustain path length I, the X electrode driver 51 repeatedly applies the negative sustain pulse $IP_x$ to the row electrodes $X_1$ to $X_n$ and the Y electrode driver 53 repeatedly applies the negative sustain pulse $IP_Y$ to the row electrodes $Y_2$ to $Y_n$. The sustain pulse is alternately applied to the row electrodes $X_1$ to $X_n$ and the row electrodes $Y_2$ to $Y_n$. The number of repetitions is equal to the number allocated to the subfield to which the sustain path length I belongs. When the sustain pulse $IP_x$ or $IP_Y$ is applied, a sustain discharge is produced between the transparent electrodes Xa and transparent electrodes Ya in the display discharge cells C1 of the pixel cells PC which have been set to lit cell mode. In FIG. 18, the direction of the discharge current of the sustain discharge is denoted by an arrow.

A negative wall charge is formed in the column electrode D-side discharge space in the display discharge cells C1 of the pixel cells PC which have been set to the lit cell mode, as a result of the application of the negative sustain pulses $IP_x$, $IP_Y$. Each sustain path length I is compulsorily terminated by the application of the sustain pulse $IP_Y$ to the row electrodes $Y_2$ to $Y_n$. Due to this termination of the sustain path length I, a positive wall charge is formed in the discharge space on the side of the row electrodes $Y_2$ to $Y_n$. Accordingly, the wall charge state at the end of the address path length W of the subfield is formed in the display discharge cells C1.

Figure 19:
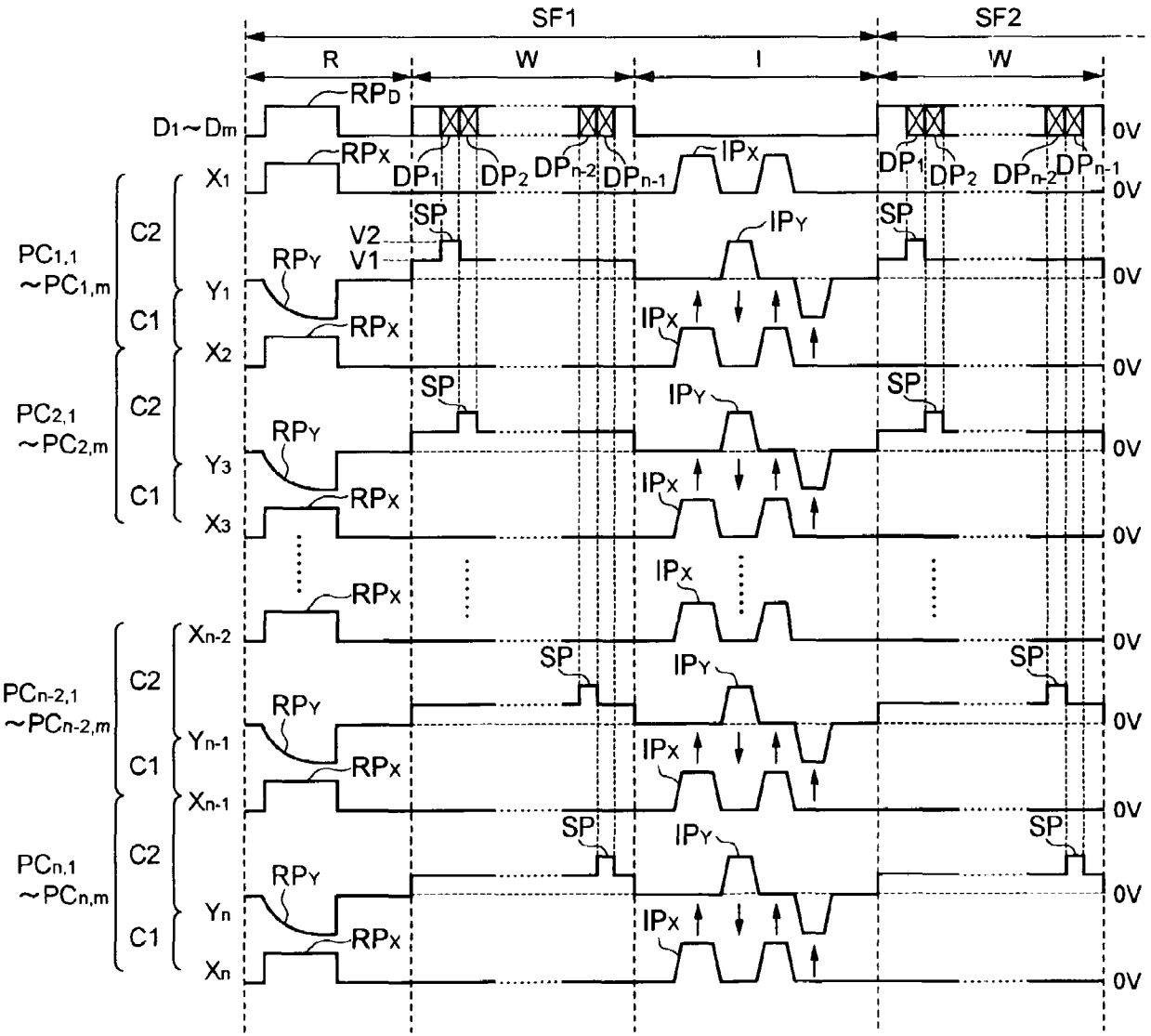
FIG. 19 shows a variety of drive pulses applied to the PDP in partial cycles of the subfields SF1 and SF of the device in FIG. 5 as well as the drive pulse application timing.

FIG. 19 shows another example of the various drive pulse waveforms applied to the PDP 50 of the plasma display device in FIG. 5. In FIG. 19, similarly to the various drive pulse waveforms shown in FIG. 12, only part of the subfield SF1 and the next subfield SF2 is shown. In the sustain path length I, the X electrode driver 51 repeatedly applies a positive sustain pulse $IP_x$ to the row electrodes $X_1$ to $X_n$ and the Y driver 53 repeatedly applies a positive sustain pulse $IP_Y$ to the row electrodes $Y_2$ to $Y_n$ and applies only the ultimate sustain pulse $IP_Y$ of the sustain path length I to the row electrodes $Y_2$ to $Y_n$ by means of a negative polarity. The application method for the sustain pulse $IP_x$ and $IP_Y$ in the sustain path length I is different from the application method for the negative polarity-sustain pulse of FIG. 12. Also in the pulse application method of FIG. 19, the sustain pulse is alternately applied to the row electrodes $X_1$ to $X_n$ and the row electrodes $Y_2$ to $Y_n$. The number of repetitions is equal to the number allocated to the subfield to which the sustain path length I belongs. When the sustain pulse IPx or $IP_Y$ is applied, a sustain discharge is produced between the transparent electrodes Xa and transparent electrodes Ya in the display discharge cells C1 of the pixel cells PC which have been set to lit cell mode. FIG. 19 shows the directions of the discharge currents of the sustain discharge by means of arrows.

Because the sustain path length I is terminated by the application of the negative sustain pulse $IP_Y$, a negative wall charge is formed in the discharge space on the column electrode D-side in the display discharge cells C1 of the pixel cells PC that have been set to the lit cell mode, and a positive wall charge is formed in the discharge space on the side of the row electrodes $Y_2$ to $Y_n$. Accordingly, the wall charge state at the end of the subfield address path length W is formed in the display discharge cells C1.

Further, also in the case of the plasma display device in FIG. 13, application in which only the ultimate sustain pulse $IP_Y$ of the sustain path length I is applied by means of a negative polarity, and the other sustain pulses $IP_x$ and $IP_Y$ are applied by means of a positive polarity is possible, as shown in FIG. 19.

As described hereinabove, according to the present invention, an increase in the speed of the selection operation can be stably implemented by raising the discharge probability of the selective discharge.

This application is based on Japanese Patent Application No. 2002-377685 which is herein incorporated by reference.

What is claimed is:

1. A display device that displays an image by dividing a single field display cycle into cycles of a plurality of subfields each having an address cycle and a sustain cycle, in accordance with pixel data for each pixel on the basis of an input picture signal, comprising:

a display panel having a front face substrate and a rear face substrate disposed facing each other with a discharge space interposed therebetween, a plurality of row electrode pairs provided on the inner face of the front face substrate, and a plurality of column electrodes arranged so as to intersect the row electrode pairs on the inner face of the rear substrate, a unit light emission region, which consists of a first discharge cell, and a second discharge cell in which a light absorption layer is provided on the front face substrate side and a secondary electron discharge material layer is provided on the rear face substrate side, being formed at each intersection between the row electrode pairs and the column electrodes;

an address part that sequentially applies a positive scan pulse to a first row electrode of each of the row electrode pairs in the address cycle while sequentially applying a pixel data pulse corresponding to the pixel data at the same timing as the scan pulse to each of the column electrodes one display line at a time so that the column electrode side constitutes a cathode, such that an address discharge is selectively produced in the second discharge cell; and a sustain part that applies a sustain pulse to each of the row electrodes constituting the row electrode pairs in the sustain cycle, wherein the sustain part applies the ultimate sustain pulse of the sustain pulses applied in the sustain cycle to the first row electrode with a negative polarity.

2. The display device according to claim 1, wherein the sustain part applies all the sustain pulses applied in the sustain cycle to the row electrode pairs with a negative polarity.

3. The display device according to claim 1, wherein the address part sets the first discharge cell to either one of a lit cell state or an unlit cell state by extending a selective address discharge in the second discharge cell to the first discharge cell.

4. The display device according to claim 1, wherein the first discharge cell comprises a part in which the first and second row electrodes constituting the row electrode pair face one another via a first discharge gap within a discharge space, and the second discharge cell comprises a part in which the column electrodes, and the first row electrode of the row electrode pair face one another via a second discharge gap within a discharge space.

5. The display device according to claim 1, wherein:

the first and second row electrodes constituting the row electrode pair each comprise a main body portion that extends in the row direction, and a protrusion that protrudes from the main body portion in the column direction so as to face each other in each of the unit light emission regions via a first discharge gap;

the first discharge cell comprises a part in which the protrusion protrudes via the first discharge gap in the discharge space; and the second discharge cell comprises a part in which the main body portion of the first row electrode of the row electrode pair, and the column electrodes face one another via a second discharge gap within a discharge space.

6. The display device according to claim 1, wherein the discharge space of the second discharge cell of each unit light emission region is closed by adjoining unit light emission region discharge spaces and barrier walls, and the discharge spaces of the first discharge cells of the respective unit light emission regions adjoining in a row direction are linked.

7. The display device according to claim 1, wherein a phosphor layer, which emits light through discharge, is formed in only the first discharge cell.

8. The display device according to claim 1, further comprising:

reset means for producing a reset discharge between the first row electrode and the column electrodes in the second discharge cell by applying a reset pulse to the first row electrode, prior to the address discharge implemented by the address part.

9. The display device according to claim 1, wherein the reset pulse has a waveform whose level transition in the rising section of the waveform or the falling section thereof is gradual in comparison with that of the sustain pulse.

10. The display device according to claim 8, wherein the reset pulse has a waveform whose level transition in the rising section of the waveform or the falling section thereof is gradual in comparison with that of the sustain pulse.

11. A drive method that drives a display panel in accordance with pixel data for each pixel on the basis of an input image signal, the display panel having a front face substrate and a rear face substrate disposed facing each other with a discharge space interposed therebetween, a plurality of row electrode pairs provided on the inner face of the front face substrate, and a plurality of column electrodes arranged so as to intersect the row electrode pairs on the inner face of the rear substrate, a unit light emission region, which consists of a first discharge cell, and a second discharge cell in which a light absorption layer is provided on the front face substrate side and a secondary electron discharge material layer is provided on the rear face substrate side, being formed at each intersection between the row electrode pairs and the column electrodes, wherein:

a single field display cycle is constituted by cycles of a plurality of subfields each having an address cycle and a sustain cycle;

a positive scan pulse is sequentially applied to a first row electrode of each of the row electrode pairs in the address cycle while a pixel data pulse corresponding to the pixel data is sequentially applied at the same timing as the scan pulse to each of the column electrodes one display line at a time so that the column electrode side constitutes a cathode, such that an address discharge is selectively produced in the second discharge cell;

a sustain pulse is applied to each of the row electrodes constituting the row electrode pairs in the sustain cycle; and the ultimate sustain pulse of the sustain pulses applied in the sustain cycle is applied to the first row electrode with a negative polarity.

* * * * *